US011493061B2

(12) United States Patent
Krupnik et al.

(10) Patent No.: US 11,493,061 B2
(45) Date of Patent: Nov. 8, 2022

(54) CONTROL VALVE ASSEMBLY FOR AN INDIRECT PNEUMATIC CONTROL, AND METHOD FOR CONTROLLING A WORKING FLUID PRESSURE

(71) Applicant: J.D. Neuhaus Holding GmbH & Co. KG, Witten (DE)

(72) Inventors: Piotr Krupnik, Iserlohn (DE); Simon Brose, Hattingen (DE)

(73) Assignee: J.D. Neuhaus Holding GmbH & Co. KG, Witten (DE)

( * ) Notice: Subject to any disclaimer, the term of this patent is extended or adjusted under 35 U.S.C. 154(b) by 88 days.

(21) Appl. No.: 16/966,266

(22) PCT Filed: Jan. 30, 2019

(86) PCT No.: PCT/EP2019/052247
§ 371 (c)(1),
(2) Date: Jul. 30, 2020

(87) PCT Pub. No.: WO2019/149751
PCT Pub. Date: Aug. 8, 2019

(65) Prior Publication Data

US 2020/0392972 A1 Dec. 17, 2020

(30) Foreign Application Priority Data

Feb. 2, 2018 (DE) ..... 10 2018 102 397.9

(51) Int. Cl.
*F15B 13/04* (2006.01)
*F15B 13/042* (2006.01)
*F15B 13/00* (2006.01)

(52) U.S. Cl.
CPC ..... *F15B 13/0402* (2013.01); *F15B 13/042* (2013.01); *F15B 2013/008* (2013.01)

(58) Field of Classification Search
CPC ..... F15B 13/0402; F15B 13/042; F15B 13/0422; F15B 2013/008;
(Continued)

(56) References Cited

U.S. PATENT DOCUMENTS 4,798,126 A * 1/1989 Budzich ..... F15B 11/165 91/518
5,454,400 A * 10/1995 Rodgers ..... F15B 13/0422 137/596.1

(Continued)

FOREIGN PATENT DOCUMENTS

DE 1 923 759 A 11/1969
DE 1 531 294 B1 7/1970

(Continued)

OTHER PUBLICATIONS

International Search Report and Written Opinion in International Application No. PCT/EP2019/052247, dated May 24, 2019 (11 pages).

*Primary Examiner* — Kelsey E Cary
(74) *Attorney, Agent, or Firm* — Nixon Peabody LLP

(57) ABSTRACT

A control valve assembly for indirect pneumatic control and method for controlling a working fluid pressure, which enable precise, sensitive and speed-variable controlling. The assembly includes two valve units, a working fluid inlet, and a control fluid inlet. A working fluid channel connects the working fluid inlet through the two valve units to an outlet. A valve piston arranged within a valve cylinder of the valve units is movable between open and closed positions. A spring element biases the valve piston toward the closed position, and a control pressure chamber applies a control pressure counteracting the spring element's bias. When a control pressure is applied in the first chamber, the first valve piston is moved to the open position. Two opposite valve surfaces form a valve opening opened at varying widths when the valve piston is moved in the valve cylinder because of a changing control pressure, and the working pressure can be finely adjusted corresponding to the valve opening width depending on the control pressure.

9 Claims, 5 Drawing Sheets

Figure 1:
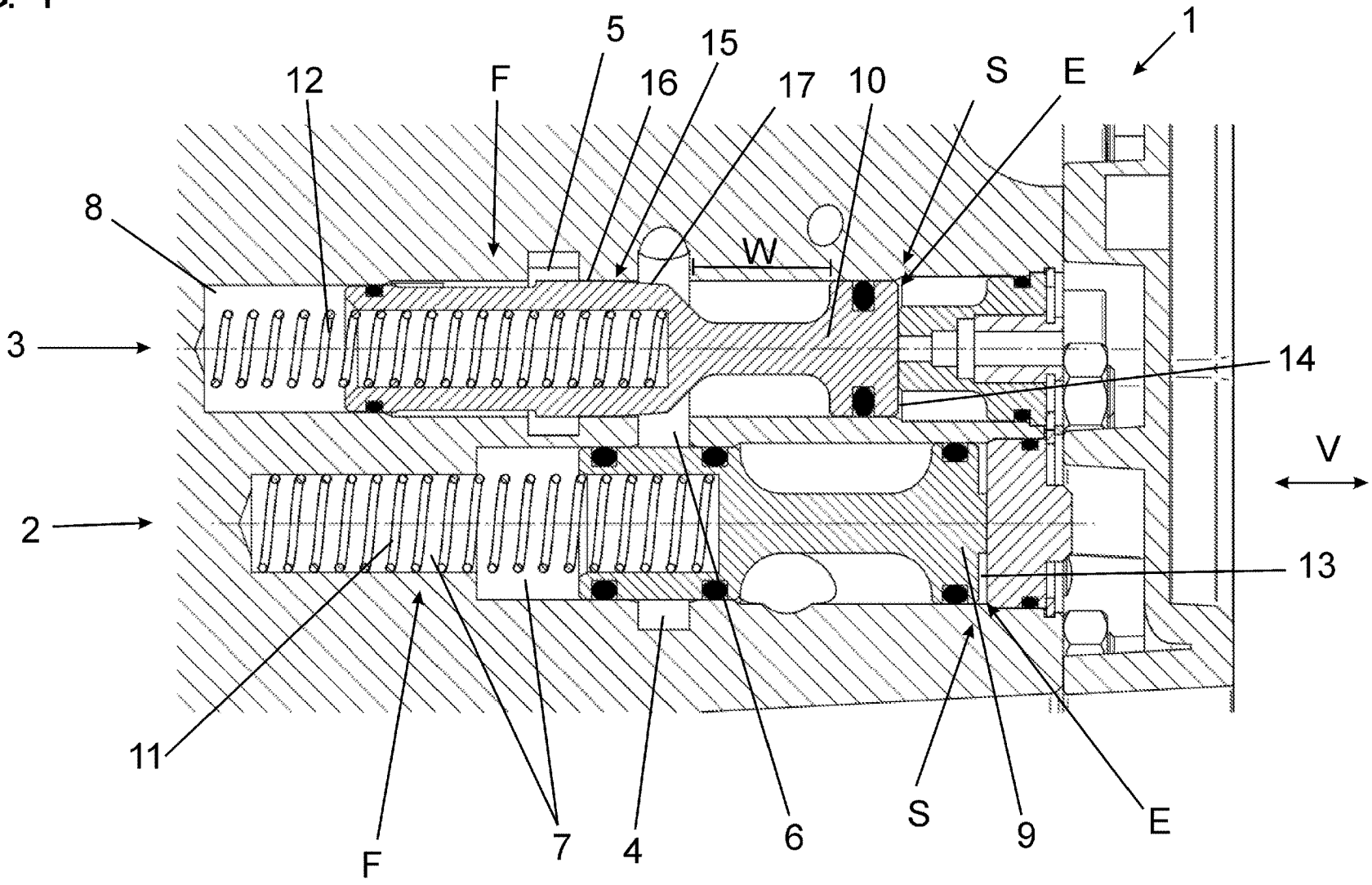

(58) Field of Classification Search
CPC ..... F15B 2211/8855; F15B 2211/7058; F15B 2211/30565; F15B 2211/329; F15B 2211/36; F15B 2211/426; F15B 2211/3144; F15B 2211/351; F15B 2211/365; F15B 2211/411; F15B 2211/41509; F16K 3/24; F16K 11/07; F16K 11/10; F16K 11/20; F16K 11/22
See application file for complete search history.

(56) References Cited

U.S. PATENT DOCUMENTS 6,470,912 B1 * 10/2002 Haynes ..... F15B 13/0402 137/596.2
RE38,355 E * 12/2003 Sandau ..... F15B 13/0433 60/452
2002/0117217 A1 * 8/2002 Liesenhoff ..... F15B 13/0402 137/596.18
2009/0053077 A1 * 2/2009 Arnett ..... F15B 13/0402 417/302
2017/0051836 A1 2/2017 Guarino
2017/0102092 A1 * 4/2017 Van de Ven ..... F16K 11/0716
2018/0106387 A1 * 4/2018 Beschorner ..... F16K 31/0613
2019/0136987 A1 * 5/2019 Bernard ..... F16K 11/0708
2019/0137004 A1 * 5/2019 Bernard ..... F15B 13/0402

FOREIGN PATENT DOCUMENTS

DE 33 45 587 A1 6/1985
DE 27 41 943 C2 9/1985
DE 20 2015 003 307 U1 8/2015
EP 0 092 279 A2 10/1983
EP 1 279 873 B1 11/2004
NL 7 611 360 A 4/1978
WO WO 2006/111031 A1 10/2006

* cited by examiner

CONTROL VALVE ASSEMBLY FOR AN INDIRECT PNEUMATIC CONTROL, AND METHOD FOR CONTROLLING A WORKING FLUID PRESSURE

CROSS-REFERENCE TO RELATED APPLICATIONS

This application is a U.S. National Stage of International Application No. PCT/EP2019/052247, filed Jan. 30, 2019, which claims the benefit of Germany Patent Application No. 10 2018 102 397.9, filed Feb. 2, 2018, both of which are incorporated herein by reference in their entireties.

The invention relates to a control valve assembly for indirect pneumatic control, as well as a method for controlling a working fluid pressure by means of a control fluid in a control valve assembly for indirect pneumatic control.

From the prior art, control valve assemblies for pneumatic control are known in a variety of designs from the prior art and are used in particular for controlling pneumatic actuators. A special field in this regard relates to the pneumatic control of pneumatically operated motors of hoists.

In this context, it is first of all known to control the motor, in particular a vane motor of a hoist directly, wherein the pressure of the working fluid, generally compressed air, is regulated directly before being fed to the pneumatically operated motor. To accomplish this, typically the compressed air provided for driving is conducted from a central connection through a hose to a manual control unit and from there to the position of the motor of the hoist that is generally positioned in an area of a hall ceiling. This makes necessary a long compressed air hose, at least from the manual control to the hoist arranged on the hall ceiling. These hoses that must continuously withstand the full working pressure of the working fluid are however relatively thick and heavy which makes them unwieldy to handle and makes operation difficult. Moreover, a correspondingly long hose between the manual control and hoist leads to performance losses that become increasingly greater with the hose length, as well as to a control delay; consequently, precise and sensitive control of a load on the hoist is no longer possible.

Moreover, indirect controls are known from the prior art in which the working fluid is connected directly to a control valve assembly on the motor, wherein the control is effected by means of a control fluid, generally also compressed air at a lower pressure than the pressure of the working fluid. In this context, it is conventional to only turn on and turn off the working fluid by means of the control valve assembly in the pneumatic motor by the control fluid applied to a manual control, whereas the working pressure and therefore the speed of the hoist are fixed and can be adjusted by means of a set screw in the control valve assembly. Consequently, this results in the disadvantage however that a change in the speed of the hoist is not readily feasible, and therefore only a slow approach and sensitive lifting, or alternatively a rapid lifting, of loads is possible. In particular when transporting heavy loads over great heights, both a fast lifting speed as well as sensitive controlling are necessary to lift and deposit the load, however.

It can therefore be considered the object of the invention to provide a control valve assembly as well as a method for controlling a working fluid pressure by means of a control fluid that enables precise, sensitive and speed-variable controlling without large performance losses and control delays.

The object is achieved according to the invention by a control valve assembly according to claim 1 as well as a correspondng method. Advantageous further embodiments of the invention are set forth in the dependent claims.

The control valve assembly according to the invention for indirect pneumatic control, in particular a pneumatically operated vane motor of a hoist, comprises two pneumatic valve units arranged functionally in sequence, a working fluid inlet and a control fluid inlet as well as a working fluid channel that connects the working fluid inlet through the two valve units to an outlet, wherein the outlet is in particular provided to supply the working fluid to a vane motor of a hoist. A valve piston arranged within a valve cylinder that can be moved between an open and a closed position is provided in each of the two valve units, wherein a spring element that biases the closed position of the valve unit acts on each of the two valve pistons. Moreover, both valve units each have a control pressure chamber connected to the control fluid inlet for applying control pressure acting against the initial bias of the spring element on the respective valve piston in order to move the valve piston against the force of the spring element into an at least partially open position.

The first valve unit is formed such that when any desired control pressure greater than 0 bar is applied in the control pressure chamber, the valve piston is moved from the closed position into a completely open position. In the second valve unit in a blocking and control region of the working fluid channel, two opposing valves surfaces at an angle to each other, and extending along the direction of movement on the surface of the valve cylinder and the valve piston, are arranged relative to each other such that the valve surfaces produce a valve opening opened at varying widths when the valve piston is moved because of the applied control pressure depending on the shifted position of the valve piston in the valve cylinder associated with the control pressure, and the working pressure can be finely adjusted corresponding to the valve opening depending on the control pressure.

The invention also relates to a hoist having a pneumatically operated vane motor and a control valve assembly according to the invention arranged upstream therefrom.

In the method according to the invention for controlling a working fluid pressure by means of a control fluid, in particular in a control valve assembly according to the invention for indirect pneumatic control, preferably for a pneumatically operated vane motor of a hoist, first a working pressure is applied by means of a working fluid to a working fluid inlet, and a control pressure of a control fluid is adjusted, in particular by means of a sensitive valve of a manual control, and the control pressure impinges on a control fluid inlet. The control fluid under the control pressure is fed into a control fluid chamber of two pneumatic valve units each, wherein the control fluid can move a valve piston biased to a closed position by a spring element and arranged within a valve cylinder to an open position.

By applying any desired control pressure in the first control pressure chamber, the first valve piston is moved from the closed into the open position which allows the working fluid to flow through the first, open valve unit to the second valve unit through a working fluid channel connected to the working fluid inlet. In so doing, applying the control pressure in the second control pressure chamber causes a movement of the second valve piston opposite the force of the spring element into a position of the valve piston in the valve cylinder associated with the control pressure between the closed and the open position, whereby the working fluid flows through the working fluid channel into the second valve unit between two opposing valve surfaces at an angle from each other extending along the direction of movement on the surface of the valve cylinder and the valve piston, wherein a valve opening in the working fluid channel formed between the valve surfaces can be correspondingly finely adjusted depending on the control pressure.

The control valve assembly according to the invention as well as the method according to the invention enable precise, sensitive and smooth controlling in a particularly easy manner, wherein the pressure of the working fluid at the outlet can be controlled for example over a wide range proportional to the pressure of the control fluid. Moreover, a variation of the pressure of the working fluid during operation by a pressure adjustment of the control fluid is easily enabled, whereby for example the speed of a motor of a hoist operated by the working fluid can be varied smoothly and sensitively. Moreover, a performance loss depending on the hoist height, or respectively on the distance to the manual control is avoided by the indirect actuation using a control fluid. Finally in addition, no control delays occur due to directly controlling the working fluid pressure with a subsequent greater working fluid volume in a long hose, etc.

The control valve assembly is in principle a module within which the pressure of a conducted and possibly blocked working fluid can be controlled by the pressure of a control fluid. Consequently according to the invention, it is a device for indirect controlling. The control valve assembly can be an independent device and in particular can be arranged in a feed line for a working fluid of an actuator, in particular a pneumatic motor. Alternatively, the control valve assembly can also be part of another device and in particular can be integrated in a hoist. Preferably, the control valve assembly is an exclusively pneumatically operated device, i.e., no additional operating medium and/or electricity is required for operation.

Each of the pneumatic valve units comprises at least one, preferably just one, valve that can be switched, or respectively controlled by means of a fluid pressure, in particular a gas pressure. Particularly preferably, each valve unit is produced by a valve that is operated exclusively pneumatically, wherein preferably this does not exclude any spring elements within the interior of the valve unit, but rather particularly preferably only refers to operation from outside. The first and second valve unit are arranged in a common housing, preferably directly bordering each other, wherein particularly preferably, the two valve cylinders are arranged parallel to each other and/or next to each other, and most preferably are produced identical to each other in terms of length and/or diameter. The valve units are arranged functionally in sequence, i.e., the working fluid supplied to the control valve assembly initially reaches the first valve unit and then, preferably with the first valve unit in an open position, enters the second valve unit.

The pressure fluids, the working fluid and/or the control fluid can in principle be any desired liquid or any desired gas. Operation with a hydraulic working and/or control fluid is in fact conceivable; however, purely pneumatic operation is preferred. Particularly preferably, the pressure fluids are each compressed air. In principle, the pressure of the working and/or control fluid can be selected as desired. Preferably, the pressure of the provided working, or respectively operating fluid is between 0 bar and 10 bar, particularly preferably a maximum of 6 bar, and most preferably precisely 6 bar, so that a constant pressure of approximately 6 bar is applied to the working fluid inlet of the control valve assembly. The maximum control pressure, i.e., the pressure of the control fluid, is preferably also 6 bar, wherein the control pressure particularly preferably can be varied between 1 bar and 6 bar by means of a control valve, in particular in a manual control. Correspondingly, preferably a pressure of a maximum 6 bar and preferable between 1 bar and 6 bar is also applied to the control fluid inlet of the control valve assembly.

The working fluid channel has in principle the task of connecting the working fluid inlet to the outlet for the working fluid within the control valve assembly and guiding the control fluid through both valve units so that the flow rate, or respectively the volumetric flow of the working fluid can be modified by both valve units. To accomplish this, the working fluid channel preferably runs through a blocking and control region of each of the two value units and in particular through the respective valve opening that is produced by the two valve surfaces of the valve cylinder and the valve piston. Preferably, the working fluid channel connects the first and second valve unit with each other such that the working fluid can flow directly from the first into the second valve unit. Particularly preferably, no other components, in particular no valves and/or branches, are arranged in the working fluid channel between the first and the second valve unit.

The spring element can in principle be any desired component or any desired assembly that is suitable for biasing the valve piston within the valve cylinder toward a closed position of the valve unit. Preferably, the spring element is a compression spring, particularly preferably a spiral spring, and/or produced as a single part. Also preferably, one side of the spring element is braced against a face, or respectively end side of the valve cylinder, and/or the other side of the spring element is braced against an end, or respectively a face of the valve piston. Most preferably, one end of the spring element is arranged at least sectionally in a hole of the valve piston. Also preferably, the hole is arranged in the end, or respectively in the face of the valve body, and/or has in particular a depth that is chosen so that the spring element can be pressed completely into the hole, and then the face of the valve piston can come into contact with a face of the valve cylinder, whereby the maximum mobility of the valve piston with respect to the valve cylinder in this direction is established particularly easily.

Preferably, the thickness of the first spring element is selected so that the valve piston reliably closes the working fluid channel without the applied pressure of the control fluid and particularly preferably at the same time so that when a predetermined minimum pressure of the control fluid is reached, preferably from 1.2 bar to 1.3 bar, the valve piston is pressed against the force of the spring element far enough in the direction of the open position in the valve cylinder to enable complete opening by the rising pressure of the working fluid in the first valve unit. In principle, the minimum pressure for opening the valve piston can however also be selected differently as desired. Preferably, the thickness of the second spring element is selected so that the valve piston is shifted to a desired extent at a given control pressure, in particular a complete movement precisely within the potential pressure limits of the control pressure, for example between 1 bar and 6 bar. To allow the pressure of the working fluid to be controlled by the control valve assembly, at least the second control pressure chamber must be completely separate from the working fluid channel. Preferably, the first control fluid chamber is also completely separate from the working fluid channel.

Preferably, any desired level of control pressure, or respectively any desired control pressure above a minimum pressure in the first control pressure chamber, is sufficient to completely open the first valve unit. The first valve unit is accordingly operated as a stop valve upstream from the second valve unit and inter alia advantageously ensures that continuous pressure is not applied to the second valve unit if no control pressure is applied to the control valve assembly. Moreover, the first valve unit forms a safety valve in order to offer double security in addition to the second valve unit against an undesired release of working pressure at the outlet. Preferably, the first valve unit can only be switched between a closed and an open state, i.e., it is a two state valve.

The second valve unit is preferably also formed so that it can completely block the working fluid. In order to allow the working fluid to pass through to a desired extent, the second valve unit has a valve opening that can be adjusted by moving the valve piston in the valve cylinder. The valve opening is formed on one side by a valve surface of the valve piston, and on an opposite side by a valve surface of the valve cylinder. In order to be able to allow a change in the size of the valve opening by a movement of the valve piston, the two valve surfaces are arranged at an angle relative to each other so that the distance between both valve surfaces is increased, or respectively decreased when the piston moves. To enable a sensitive adjustment, each of the valve surfaces on a surface of the valve piston, or respectively the valve cylinder extends at least sectionally along the direction of movement. Given a suitable selection of the spring strength of the valve unit, it is accordingly possible to provide a specific position of the valve piston in the valve cylinder between the closed and the open position for every possible control pressure so that, corresponding to the valve opening, the working pressure can be adjusted in a correspondingly sensitive manner depending on the control pressure.

In an advantageous further embodiment of the control valve assembly according to the invention, at least one of the two valve surfaces of the second valve unit has at least two, preferably just two sequential sections, wherein particularly preferably, the angle between the valve surfaces in the first section following the closed position is smaller than the angle of the valve surfaces in the second region adjacent to the open position, whereby a particularly sensitive starting and slow lifting and lowering are possible in a hoist. Preferably, one of the two valve surfaces has a changing angle between the first and the second section, and particularly preferably, the other valve surface is produced without a change in angle. Also preferably, the two sections of a valve surface are clearly demarcated from each other, i.e., the angle between the sections does not change continuously but rather suddenly, or respectively in a position. It is also preferable for the angle of the valve surfaces to be at least twice as large in the second section, particularly preferably at least five times as large, and most preferably at least 10 times as large as the angle of the valve surfaces in the first section. Correspondingly in the second section of the valve surfaces, the diameter of the valve piston, or respectively the distance between the two opposing valve surfaces is preferably at least twice as large, particularly preferably at least five times as large, and most preferably at least 10 times as large as in the first section. Particularly preferably, both sections are formed so that they enable control of the flow rate of the working fluid between a fully blocked state and a fully open state, wherein to begin with, slow and sensitive starting is possible, as well as rapid lifting of a load using a hoist with a higher control pressure. Most preferably, in addition to a closed and an open state, the two sections are additionally controllable. According to a preferred embodiment of the control valve assembly according to the invention, the two valve surfaces in the first and/or second section, at least relative to each other, are preferably formed to run linearly in each case, wherein the angle between the two valve surfaces of the first section is preferably between 0.1° and 15°, particularly preferably between 1° and 10°, and most preferably between 2° and 7°, and the angle of the second section is between 5° and 85°, particularly preferably between 10° and 75°, and most preferably between 200 and 65°. Especially preferably, the angle in the first section is 2°, and/or the angle in the second section is 45°. Also preferably, both valve surfaces in the first and/or second section extend with a constant angle relative to each other along the surface of the valve cylinder, or respectively the valve piston so that the distance between both valve surfaces relative to each other increases continuously, in particular from the closed position to the open position.

One embodiment of the control valve assembly provides that at least one of the two valve surfaces in the first and/or second section is formed to run non-linearly, wherein the angle between the two opposing valve surfaces of the valve piston and the valve cylinder preferably increases between the closed and the open position, and the angle of the first section is also preferably between 0.1° and 15°, particularly preferably between 1° and 10°, and most preferably between 2° and 7°, and the angle of the second section is between 5° and 85°, particularly preferably between 10° and 75°, and most preferably between 20° and 65°. Most preferably, one of the valve surfaces of the valve piston or the valve cylinder is formed to run nonlinearly in one or both sections, whereas the opposing valve surface of the valve cylinder or of the valve piston runs linearly.

In general, a contour of the valve surfaces relative to each other with an increasing valve opening toward the open position of the valve piston is preferred. Likewise it is generally preferred for the valve surface of the valve piston or the valve cylinder to be arranged parallel to the adjustment direction of the valve piston in the valve cylinder in at least one section, and particularly preferably in both sections, whereas the other opposing valve surface is arranged at an angle thereto with a linear or nonlinear contour. An embodiment with a contour of the valve surface having a first linear section with a small angle and a second linear section with a larger angle is particularly preferred.

In a preferred embodiment of the control valve assembly according to the invention, the first section and/or the second section of the valve surfaces extend over at least 15%, percent, preferably at least 25%, particularly preferably at least 30%, and most preferably over at least 40% of the maximum adjustment path of the valve piston relative to the valve cylinder, whereby particularly sensitive controlling can be achieved. Also preferably, the first section extends over a maximum 80%, preferably 60%, particularly preferably 50% and most preferably 40% of the maximum adjustment path. Also preferably, both sections extend together over at least 50%, particularly preferably at least 75% and most preferably at least 80% of the maximum adjustment length of the valve piston.

Moreover, an embodiment of the control valve assembly is preferred in which at least the second valve piston, preferably also the first valve piston, is formed rotationally symmetrical about an axis along the adjustment direction, and the corresponding valve cylinder has a round cross-section so that the valve opening has the shape of an annular gap. Correspondingly, at least one valve surface preferably has a conical shape, whereas the second valve surface is also preferably formed cylindrically or conically.

Also preferred is an embodiment of the control valve assembly in which the first and/or second control pressure chamber is arranged in the region of the end of the respective valve piston opposite the spring element, and/or the working fluid channel is arranged in the first and/or second valve unit between the region of the spring element and the region of the control pressure chamber. Particularly preferably, the working fluid channel surrounds the respective valve piston within the valve cylinder sectionally on all sides. Also preferably, the working fluid channel is formed sectionally by the valve cylinder.

In an advantageous further embodiment of the control valve assembly according to the invention, a manual control unit is arranged in front of the control fluid inlet and has a manual regulator by means of which the control pressure of the control fluid can be smoothly regulated, wherein the manual regulator particularly preferably comprises a manually activated gas valve by means of which the control pressure can be adjusted smoothly and sensitively.

Finally, the control valve assembly preferably has just one single control fluid inlet that is connected to both control pressure chambers in the interior of the control valve assembly so that the control pressure is always the same in both control pressure chambers. Especially preferably, the control valve assembly also only has just one working fluid inlet and/or one working fluid outlet.

Figure 2:
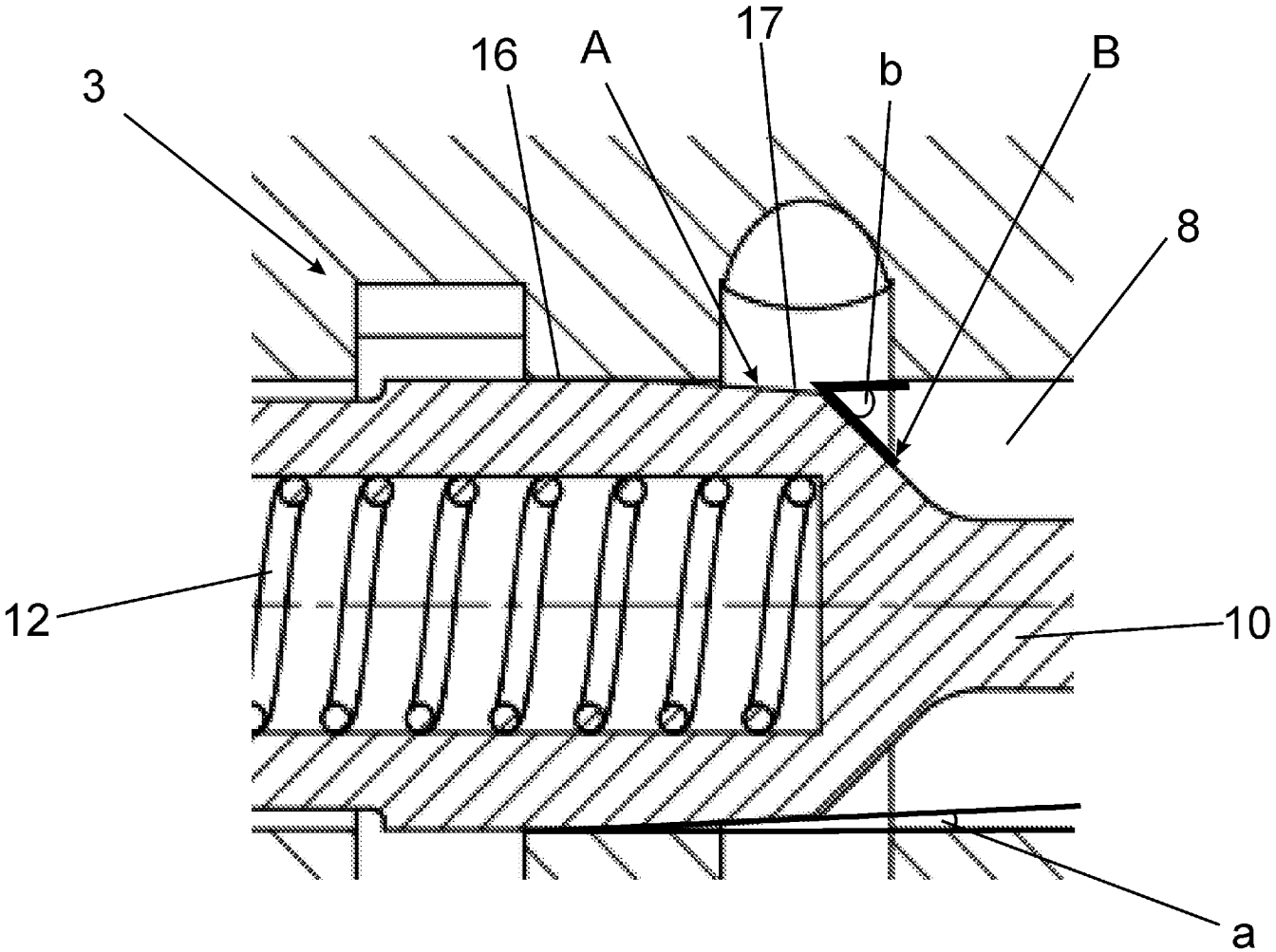
Figure 3:
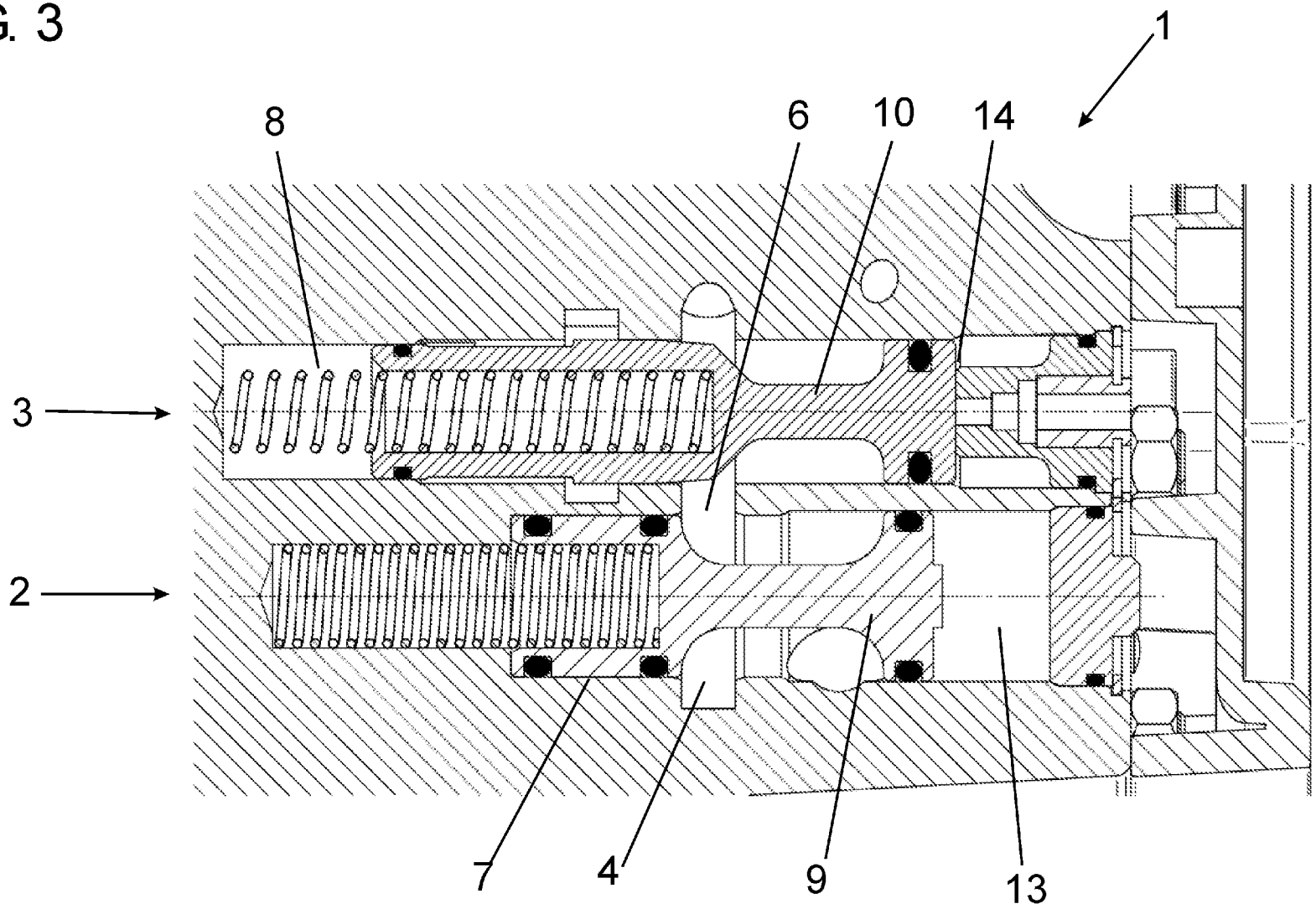
Figure 4:
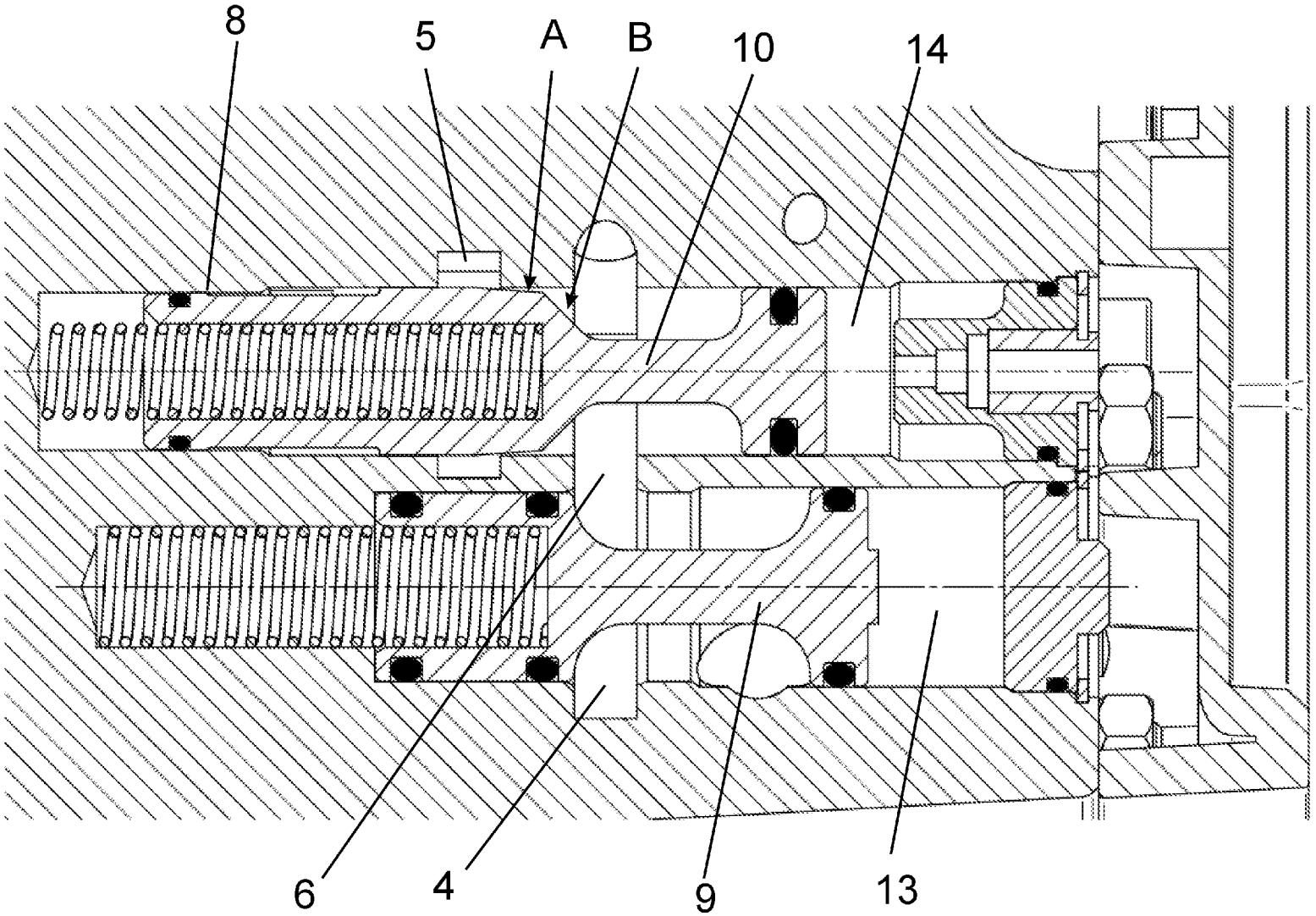
Figure 5:
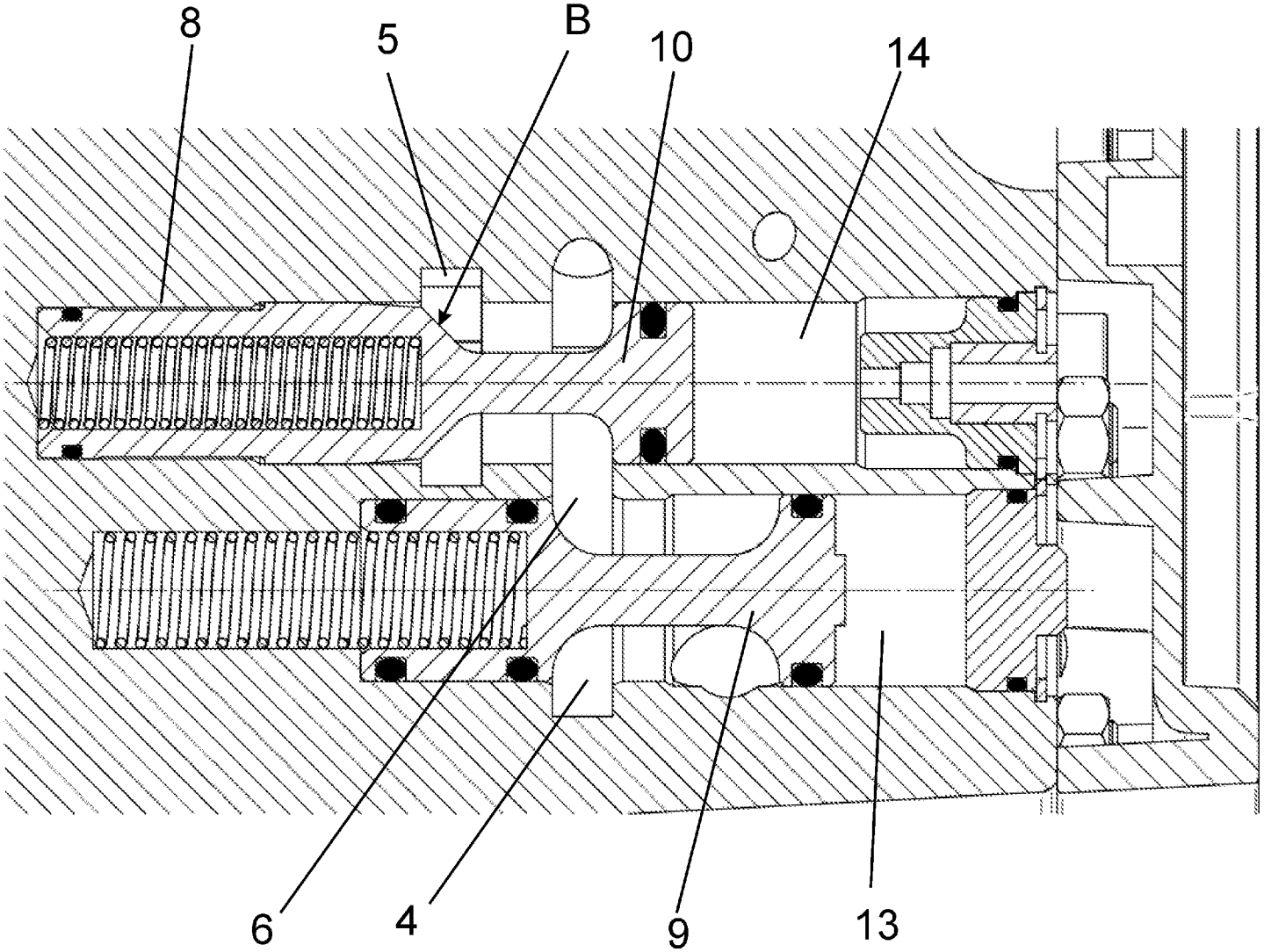

An exemplary embodiment of the control valve assembly according to the invention is explained in greater detail below with reference to the drawings. In the figures:

FIG. 1 shows a sectional view of a control valve assembly with two closed valve units, FIG. 2 shows an enlarged sectional view of a blocking region of the second valve unit of the control valve assembly portrayed in FIG. 1, FIG. 3 shows a sectional view of the control valve assembly portrayed in FIG. 1 with an open first valve unit and a closed second valve unit, and FIG. 4 shows a sectional view of the control valve assembly portrayed in FIG. 1 with a fully open first valve unit and a partially open second valve unit, FIG. 5 shows a sectional view of the control valve assembly portrayed in FIG. 1 with two open valve units.

With a control valve assembly 1 portrayed in FIG. 1 for the indirect pneumatic control of the working pressure for a pneumatic vane motor of a hoist, a first and a second valve unit 2, 3 are arranged parallel to each other in a common housing.

Each of the two valve units 2, 3 is formed as a spring-biased pneumatically operated valve. Correspondingly, a movable valve piston 9, 10 is arranged in a valve cylinder 7, 8 in each of the valve units 2, 3 such that a pressure fluid, in particular compressed air, guided through the valve unit 2, 3 can be blocked, or respectively regulated by means of a surface section of the valve cylinder 7, 8 and of the valve piston 9, 10.

On one side, the valve piston 9, 10 is biased by a spiral spring 11, 12 toward a closed position, wherein one end of the spiral spring 11, 12 braces against a round face of the valve cylinder 7, 8, whereas the other end is secured within a hole in the valve piston 9, 10. At the other end E of the valve piston 9, 1*o*, a control pressure chamber 13, 14 is produced in the valve cylinder 7, 8. The control pressure chambers 13, 14 of both valve units 2, 3 are jointly connected to an inlet for a control pressure airflow so that pressure can build up in the control pressure chamber 13, 14 that counteracts the spring tension of the spiral spring 11, 12 and allows the valve piston 9, 10 to be moved by applying the control pressure to the face of the valve piston 9, 10.

The control valve unit 1 has a working pressure air inlet 4 as well as a corresponding outlet 5 that provides a pressure-controlled compressed air flow for the vane motor of the hoist. The outlet 5 is connected to the working pressure air inlet 4 through a working pressure air channel 6, wherein the working pressure air channel 6 runs sequentially through both valve units 2, 3 and can be blocked and regulated in each case in a blocking and control region 15 by means of the valve units 2, 3.

A valve surface 16, 17 is arranged on both the second valve piston 10 as well as the associated valve cylinder 8 that lie against each other when the valve unit 2, 3 is in a closed state. Both valve surfaces 16, 17 are arranged at an angle to each other so that when the valve piston 10 moves in the valve cylinder 8, an enlarging valve opening forms in the shape of an annular gap as movement increases.

FIG. 1 shows a control valve assembly 1 with both valve units 2, 3 in the closed position so that the first valve unit 2 blocks the working pressure air flow just after the working pressure air inlet 4, and no pressure in the region of the working pressure air channel 6 is applied to the second valve unit 3. In this state of the control valve assembly 1, there is also no control pressure, or respectively the control pressure of the control pressure air in the control pressure chambers 13, 14 lies below a fixed threshold value of approximately 1.2 bar for opening the valve units 2, 3.

FIG. 3 shows a control valve assembly 1 in a state that only occurs briefly, or respectively exactly upon reaching a threshold value of the control pressure for opening the valve units 2, 3. The first valve unit 2 is completely open, whereas the second valve unit 3 is still closed. The control pressure in the first control air pressure chamber 13 counteracts the first spiral spring 11 enough to just open the valve opening of the first valve unit 2 in that the two valve surfaces 16, 17 of the first valve unit 2 disengage.

As the control pressure increases, the second valve piston 10 of the second valve unit 3 now is also moved against the spring force of the spiral spring 12 toward the open position, wherein the spring force is selected so that the valve piston 10 is shifted over the maximum adjustment path W within a predefined pressure range, preferably between 1 bar and 6 bar.

In order to first of all enable a sensitive control and then a quick and forceful release of the working air pressure as the control pressure increases, the valve surfaces 16, 17 of the second valve unit 3 are formed by a changing angle a, b within the control surface 17 of the valve piston 10 (see FIG. 2). The valve surface 16 of the valve cylinder 8 is produced as a linearly running cylindrical surface as part of the wall of the valve cylinder 8. The valve surface 17 of the valve piston 10 has two sections A, B at an angle to each other which are each also arranged at an angle a, b to the opposing valve surface 16. Both sections A, B have a linear contour. The angle a of the first section of the valve surface 17 to the opposing valve surface 16 is 5°, whereas the corresponding angle b of the second section B is 45°. The two sections A, B extend over 85% of the maximum adjustment path W of the valve piston 10 in the valve cylinder 8.

FIG. 4 shows a control valve assembly 1 with the first valve unit 2 in the completely open position and the second valve unit 3 in a partially open position, wherein the working pressure air is guided through an annular gap formed by the control surfaces 16, 17 of the second valve unit 3, and a reduced volumetric flow through this annular gap can flow through the working pressure air channel 6 from the working air pressure inlet 4 to the outlet 5 of the control valve assembly.

Finally, FIG. 5 shows a control valve assembly 1 with both valve units 2, 3 in the completely open position, wherein the working pressure air can flow unhindered through the working pressure air channel 6 from the working air pressure inlet 4 to the outlet 5 of the control valve assembly through the control surfaces 16, 17 of the two valve units 2, 3.

LIST OF REFERENCE NUMBERS

1 Control valve assembly
2 First valve unit
3 Second valve unit
4 Working fluid inlet
5 Outlet
6 Working fluid channel
7 First valve cylinder
8 Second valve cylinder
9 First valve piston
10 Second valve piston
11 First spring element
12 Second spring element
13 First control pressure chamber
14 Second control pressure chamber
15 Blocking and control region
16 First valve surface
17 Second valve surface
A First section
B Second section
E End of the valve piston
F Region of the spring element
S Region of the control pressure chamber
V Adjusting direction
W Maximum adjustment path
a Angle of the first section
b Angle of the second section

The invention claimed is:

1. A control valve assembly for an indirect pneumatic control, comprising two pneumatic sequentially arranged valve units, one working fluid inlet and one control fluid inlet, a working fluid channel connecting the working fluid inlet through the two valve units, to an outlet, in each valve unit, a valve piston arranged within a valve cylinder of the first and second valve unit and movable between an open and a closed position, in each valve unit, a spring element which biases the first and the second valve piston toward the closed position, in each valve unit, a control pressure chamber connected to the control fluid inlet for applying a control pressure counteracting the bias of the spring element to the respective valve piston, wherein the first valve unit is formed such that when a control pressure is applied in the first control pressure chamber, the first valve piston is moved from the closed to the open position, and wherein two opposite valve surfaces which are angled relative to each other are arranged on the valve cylinder and the valve piston so as to extend along the direction of movement in the second valve unit in a blocking and control region of the working fluid channel such that the valve surfaces form a valve opening opened at varying widths when the valve piston is moved in the valve cylinder because of a changing control pressure, and the working pressure is graduated adjustable corresponding to the valve opening width depending on the control pressure.

2. The control valve assembly according to claim 1, wherein at least one of the two valve surfaces of the second valve unit has two sequential sections, wherein an angle (a) between the valve surfaces in the first section following the closed position is smaller than an angle (b) of the valve surfaces in the second section adjacent to the open position.

3. The control valve assembly according to claim 2, wherein the two valve surfaces in the first and/or second section (A, B) are produced to run linearly, wherein the angle (a, b) between the two valve surfaces is between 0.1° and 10°.

4. The control valve assembly according to claim 2, wherein at least one of the two valve surfaces is formed to run nonlinearly in the first and/or second section, wherein an angle between the two valve surfaces increases between the closed and the open position and is between 0.1° and 45°.

5. The control valve assembly according to claim 2, wherein the first section and/or the second section of the valve surfaces extends in each case over at least 25% of the maximum adjustment path of the valve piston relative to the valve cylinder.

6. The control valve assembly according to claim 1, wherein at least the second valve piston is formed rotationally symmetrical, and the corresponding valve cylinder has a round cross-section so that the valve opening has the shape of an annular gap.

7. The control valve assembly according to claim 1, wherein the first and/or second control pressure chamber is arranged in a region of an end of the respective valve piston opposite the spring element, and/or the working fluid channel in the first and/or the second valve unit is arranged between a region (F) of the spring element and a region of the control pressure chamber.

8. The control valve assembly according to claim 1, wherein a single control fluid inlet that is connected to both control pressure chambers in an interior of the control valve assembly.

9. A method for controlling a working fluid pressure by a control fluid in a control valve assembly for an indirect pneumatic control, comprising the steps of:

applying a working pressure by a working fluid to a working fluid inlet, controlling a control pressure in a control fluid and subjecting a control fluid inlet to the control pressure, feeding the control fluid into a control pressure chamber of each of a first and a second pneumatic valve unit, wherein the control fluid can move a first valve piston of the first pneumatic valve unit and a second valve piston of the second pneumatic valve unit, each arranged within a valve cylinder, to an open position, wherein each of the valve piston is biased by a spring element toward a closed position, wherein applying the control pressure in the first control pressure chamber moves the first valve piston from the closed into the open position, whereby the working fluid can flow through the first valve unit now being open to the second pneumatic valve unit through a working fluid channel connected to the working fluid inlet, wherein applying the control pressure in the second control pressure chamber causes a movement of the second valve piston against the force of the spring element into a position of the second valve piston in the valve cylinder associated with the control pressure between the closed and the open position, whereby the working fluid flows through the working fluid channel into the pneumatic second valve unit between two opposing valve surfaces at an angle from each other and extending along a direction of movement on a surface of the valve cylinder and the valve piston, wherein a valve opening in the working fluid channel formed between the valve surfaces is correspondingly graduated adjustable depending on the control pressure, and regulates the pressure of the working fluid applied to an outlet.

* * * * *